US009855652B2

(12) United States Patent
Chen

(10) Patent No.: US 9,855,652 B2
(45) Date of Patent: Jan. 2, 2018

(54) RATCHET WRENCH TOOL SET

(71) Applicants: Yung-Chih Chen, Taichung (TW); Chao-Yuan Yang, Taichung (TW)

(72) Inventor: Yung-Chih Chen, Taichung (TW)

(73) Assignees: Yung-Chih Chen, Taichung (TW); Chao-Yuan Yang, Taichung (TW)

( * ) Notice: Subject to any disclaimer, the term of this patent is extended or adjusted under 35 U.S.C. 154(b) by 263 days.

(21) Appl. No.: 14/821,779

(22) Filed: Aug. 9, 2015

(65) Prior Publication Data

US 2016/0046013 A1 Feb. 18, 2016

(30) Foreign Application Priority Data

Aug. 14, 2014 (TW) ..... 103127939 A

(51) Int. Cl.

| | |
|---|---|
| ***B25G 1/08*** | (2006.01) |
| ***B25B 15/04*** | (2006.01) |
| ***B25G 3/38*** | (2006.01) |
| ***B25B 13/46*** | (2006.01) |
| ***B25B 13/56*** | (2006.01) |
| ***B25B 27/00*** | (2006.01) |

(52) U.S. Cl.

CPC ..... *B25G 1/085* (2013.01); *B25B 13/463* (2013.01); *B25B 13/56* (2013.01); *B25B 27/0071* (2013.01); *B25G 3/38* (2013.01)

(58) Field of Classification Search

CPC .. B25G 1/085; B25G 3/28; B25G 3/38; B25B 13/56; B25B 13/463; B25B 27/0071

USPC ..... 81/60, 490, 106; 7/165

See application file for complete search history.

(56) References Cited

U.S. PATENT DOCUMENTS

| | | | | |
|---|---|---|---|---|
| 5,499,562 A * | 3/1996 | Feng | B25G 1/085 | 81/177.4 |
| 5,517,885 A * | 5/1996 | Feng | B25G 1/085 | 81/177.4 |
| 6,305,254 B1 * | 10/2001 | Hsieh | B25B 13/04 | 81/124.5 |
| 8,783,138 B2 * | 7/2014 | Johnson | B23Q 13/00 | 81/439 |
| 2011/0041657 A1 * | 2/2011 | Hung | B25B 15/04 | 81/60 |

* cited by examiner

*Primary Examiner* — Hadi Shakeri
(74) *Attorney, Agent, or Firm* — Leong C. Lei

(57) ABSTRACT

A ratchet wrench tool set includes a box, tool bits receivable in the box, two side boards mounted to two sides of the box, and a ratcheting device. The ratcheting device includes a rotary connection plate to which a ratcheting head is mounted. The rotary connection plate is rotatably mounted to the two side boards and rotatable between an operation position and a storage position and includes a constraint step section. The slidable constraint cover has a front end that forms a constraint projection section and is slidably mounted between the two side boards. When the slidable constraint cover is moved frontwards, the constraint projection section engages the constraint step section to retain the ratcheting device in the operation position and when the slidable constraint cover is moved rearward, the constraint projection section disengages from the constraint step section to allow the ratcheting device to rotate to the storage position.

10 Claims, 9 Drawing Sheets

RATCHET WRENCH TOOL SET

(a) TECHNICAL FIELD OF THE INVENTION

The present invention relates generally to a ratchet wrench tool set, and more particularly to a ratchet wrench tool set featuring a greatly reduced size and improved integration and easy use.

(b) DESCRIPTION OF THE PRIOR ART

A conventional ratchet wrench tool set comprises a ratchet wrench and also comprises a plurality of tool bits and a toolbox that receives and holds the ratchet wrench and the tool bits.

However, the ratchet wrench is made up of a ratcheting head and a handle connected to the ratcheting head. Inevitably, the size of the toolbox that receives and holds the ratchet wrench must be bulky.

For a bicycle rider, when doing exercise or working out by riding a bicycle, he or she will encounter certain malfunction issues of the bicycle. Disassembling and/or repairing is often necessary to be conducted on site. For such a reason, bicycle riders may carry a ratchet wrench tool set. However, the large size of the ratchet wrench tool set causes a problem for carrying and sometimes, the function provided thereby may not be sufficient so that additional chain remover or inflation can must be carried, this being an additional problem.

SUMMARY OF THE INVENTION

To overcome the problems that the conventional ratchet wrench tool set has a relatively large size, is not easy to carry, and may not have sufficient functions, the present invention aims to provide a ratchet wrench tool set, which generally comprises a box, which defines therein a receiving space; a plurality of tool bits, which are removably received in the receiving space of the box; two side boards, which are respectively mounted to two opposite sides of the box, each of the side boards having an inside surface in which a slide groove is formed; a ratcheting device, which comprises a rotary connection plate and a ratcheting head mounted to the rotary connection plate, the rotary connection plate being rotatably coupled to front ends of the two side boards to be reciprocally rotatable between an operation position and a storage position, the rotary connection plate comprising a constraint step section thereon; and a slidable constraint cover, which has a front end comprising a constraint projection section formed thereon and two opposite sides each comprising a slide protrusion formed thereon, the slide protrusions being respectively and slidably received in the slide grooves of the two side boards to allow the slidable constraint cover to move frontwards and rearwards through sliding along the slide grooves. When the slidable constraint cover is moved frontwards through sliding, the constraint projection section engages the constraint step section of the ratcheting device to retain the ratcheting device in the operation position. When the slidable constraint cover is moved rearwards through sliding, the constraint projection section disengages from the constraint step section to allow the ratcheting device to rotate to the storage position. The present invention helps improves the functionality and convenience and also help reduces the overall size for easy carrying.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
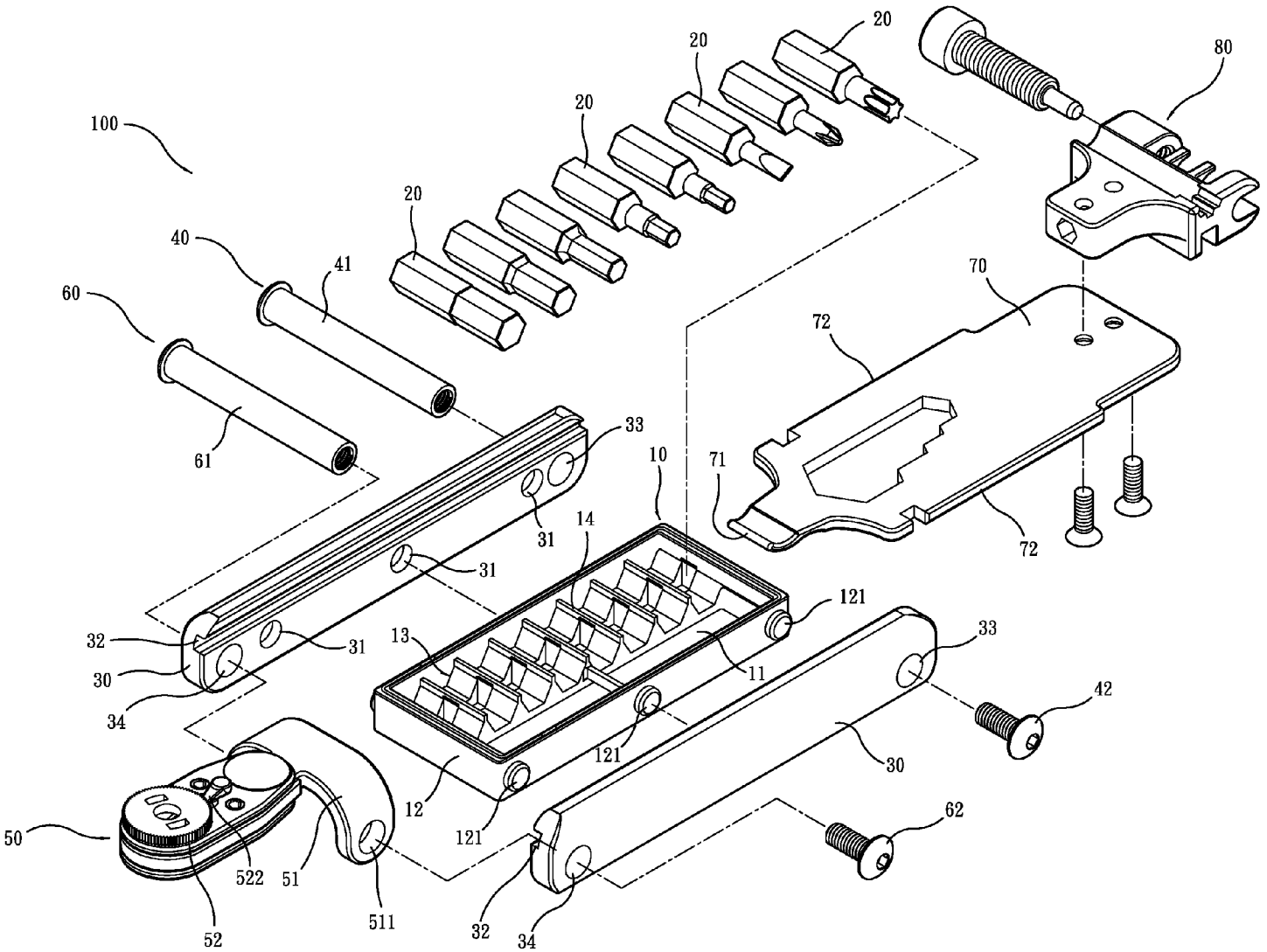
FIG. 1 is an exploded view of a preferred embodiment of the present invention.
Figure 2:
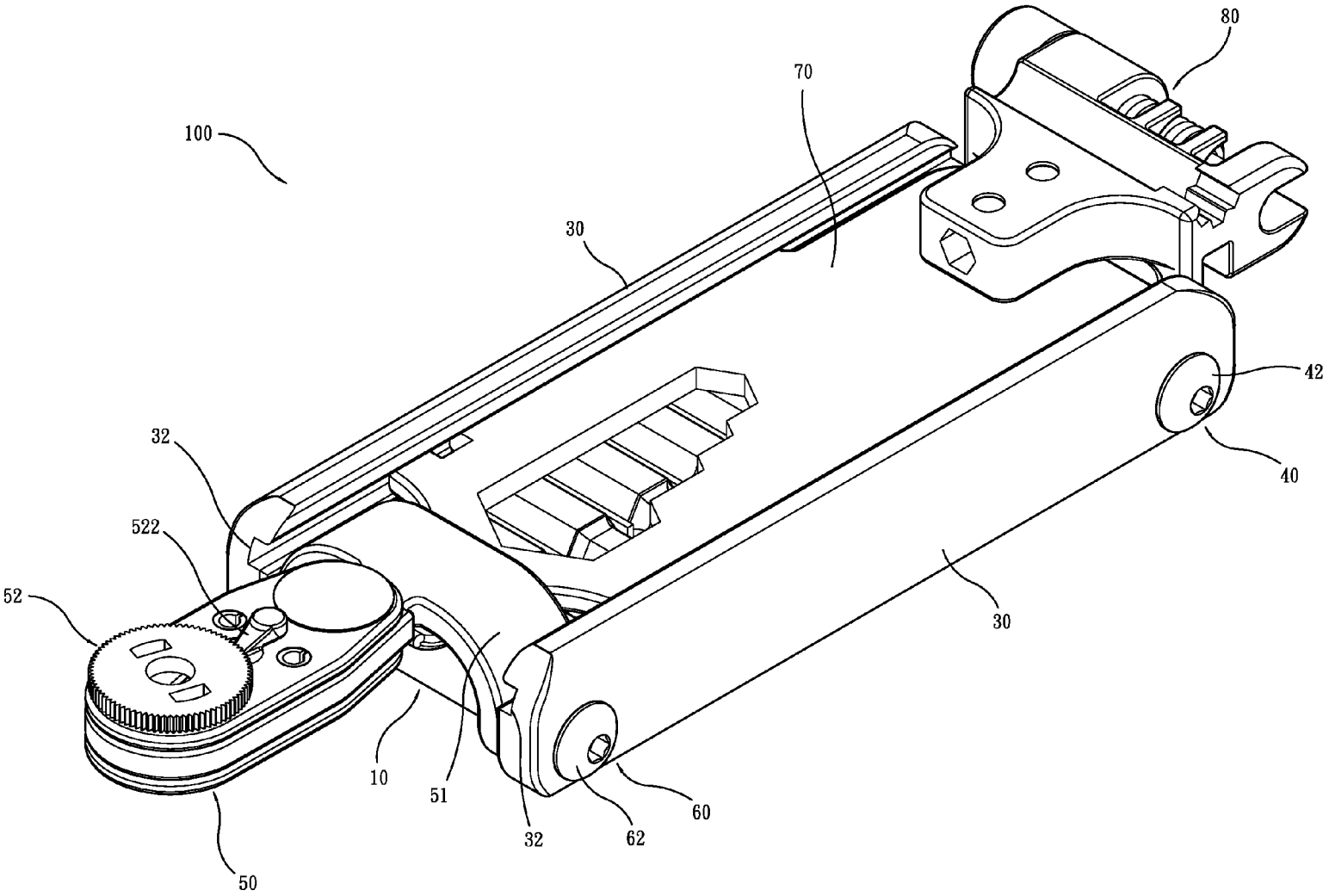
FIG. 2 is a perspective view illustrating the embodiment of FIG. 1 in an assembled form.
Figure 3:
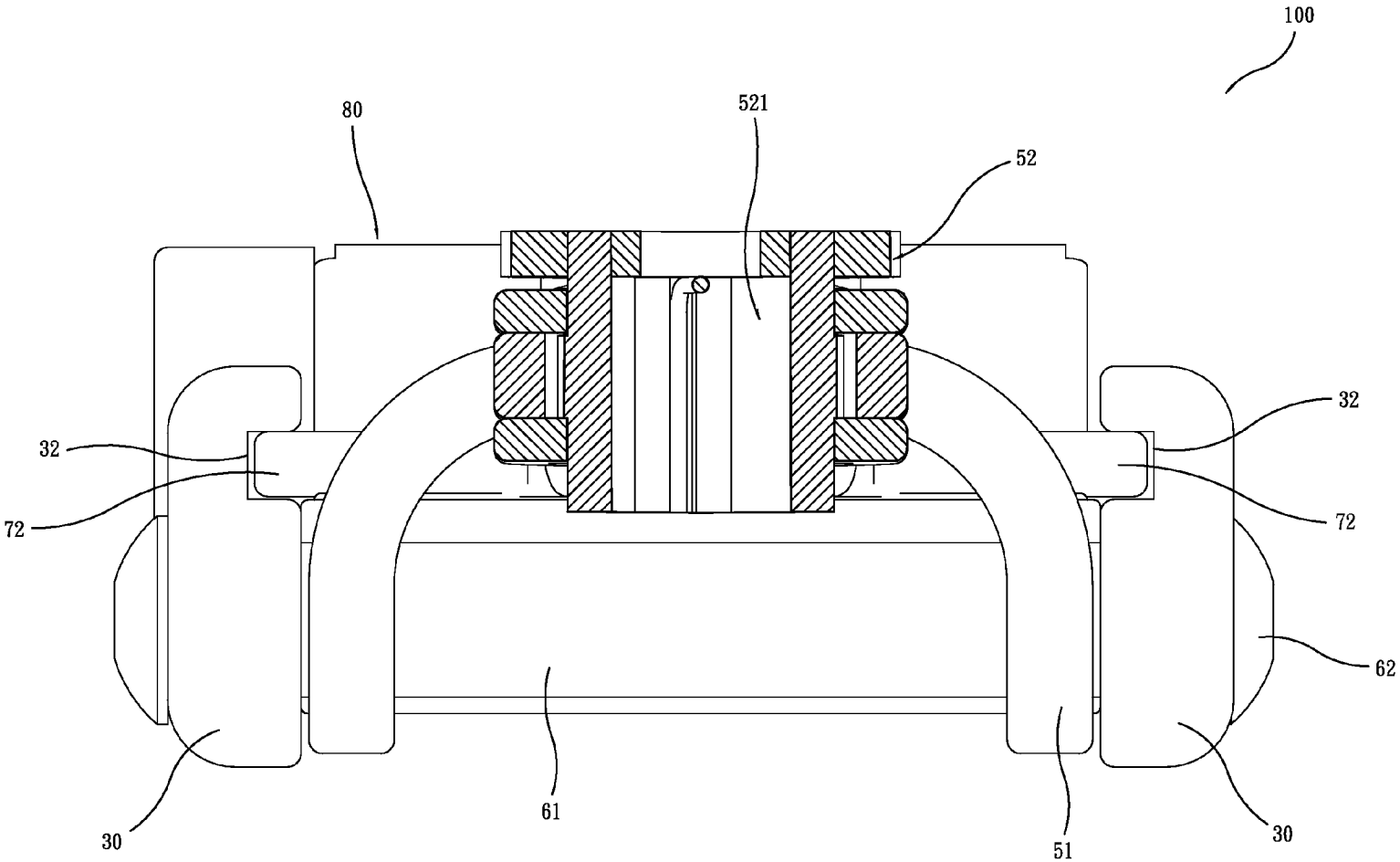
FIG. 3 is a cross-sectional view of the embodiment of FIG. 1.
Figure 4:
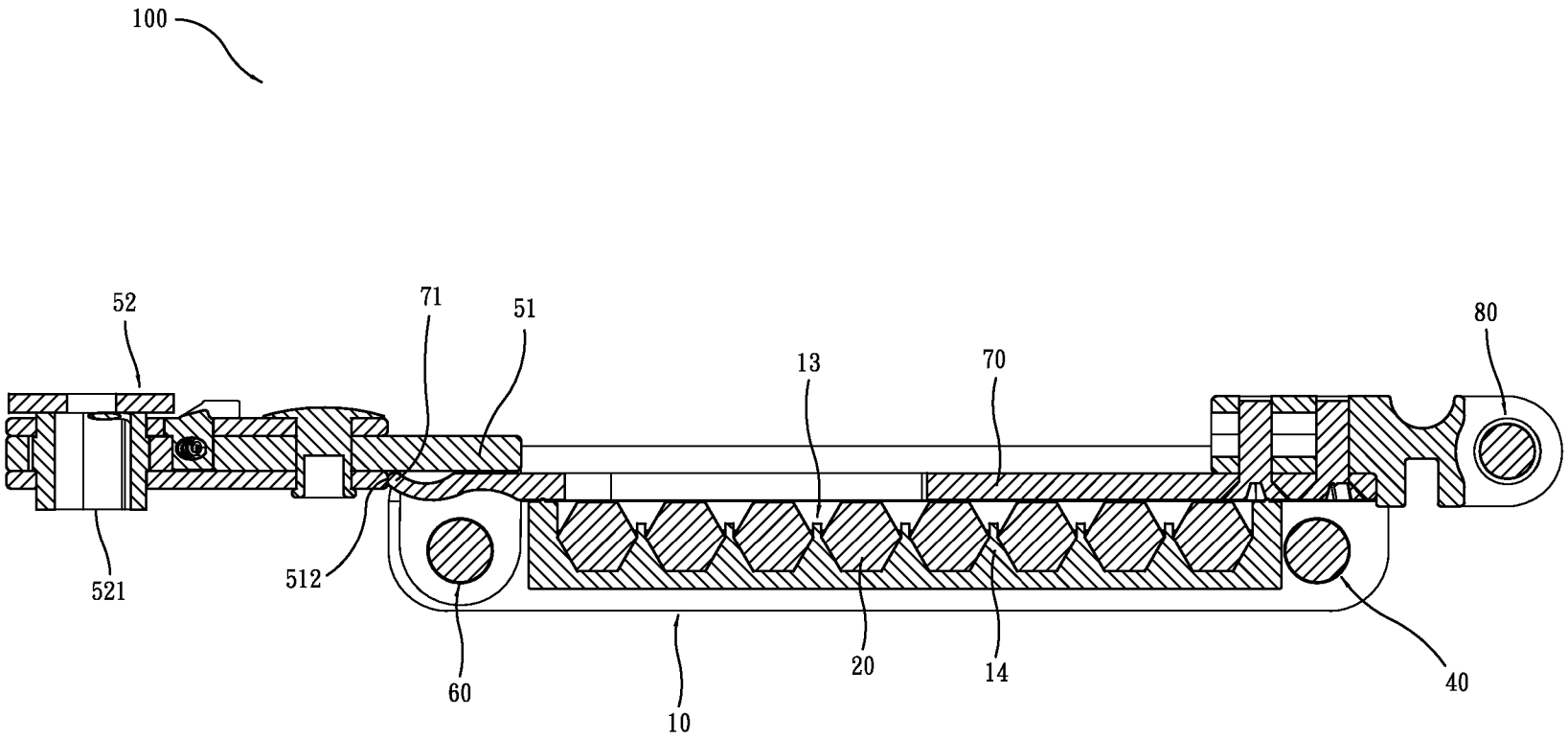
FIG. 4 is another cross-sectional view of the embodiment of FIG. 1.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1-9, a ratchet wrench tool set 100 according to a preferred embodiment of the present invention generally comprises a box 10, a plurality of tool bits 20, two side boards 30, a fastening member 40, a ratcheting device 50, a rotary joint member 60, a slidable constraint cover 70, and a chain tool 80.

Referring to FIGS. 1-4, the box 10 comprises a bottom wall 11, a circumferential wall 12 integrally formed with and extending upward from a circumference of the bottom wall 11, a receiving space 13 surrounded by and delimited collectively by the bottom wall 11 and the circumferential wall 12, and a plurality of clamp blocks 14 formed on the bottom wall 11 and arranged in the receiving space 13 in a predetermined pattern. The circumferential wall 12 has two opposite outside surfaces on each of which a plurality of first positioning sections 121 is formed. In the instant embodiment, the first positioning sections 121 are each a raised block.

Referring to FIGS. 1-4, the tool bits 20 include a number of hexagonal bits and screwdriver bits of different types and are received in the receiving space 13 of the box 10 and are releasably retained and secured in position by the clamp blocks 14.

Referring to FIGS. 1-4, each of the side boards 30 has an inside surface in which a plurality of second positioning sections 31 and a slide groove 32 are formed. The second positioning sections 31 of the two side boards 30 are engageable with and thus coupled to the first positioning sections 121 formed on the two opposite sides of the circumferential wall 12 of the box 10, respectively, in order to set and fix the two side boards 30 on the two opposite outside surfaces of the box 10 respectively. Each of the side boards 30 comprises a fastening through-hole 33 formed therein at a location adjacent to a rear end thereof and each of the side boards 30 comprises a rotary joint through-hole 34 formed therein at a location adjacent to a front end thereof.

Referring to FIGS. 1-4, the fastening member 40 comprises an elongate nut 41 and a bolt 42 and is received through and positioned in and between the two corresponding fastening through-holes 33 of the two side boards 30 in order to fix the two side boards 30 to the two outside surfaces of the box 10.

Referring to FIGS. 1-4, the ratcheting device 50 comprises a rotary connection plate 51 and a ratcheting head 52 mounted to the rotary connection plate 5. The rotary connection plate 51 has two side portions each comprising a rotatable connection hole 511 corresponding in position to each other. The rotary connection plate 51 has a bottom surface on which a constraint step section 512 is formed. The ratcheting head 50 comprises a ratchet bore 521 that selectively and alternately receives the tool bits 20 to fit therein in order to apply a torque and rotation to an object to be rotated (not shown) in a one-way manner.

Referring to FIGS. 1-4, the rotary joint member 60 comprises an elongate nut 61 and a bolt 62 and is rotatably received through the corresponding rotary joint through-holes 34 of the two side boards 30 and the rotatable connection holes 511 of the ratcheting device 50 in order to rotatably couple the rotary connection plate 51 between the front ends of the two side boards 30.

Referring to FIGS. 1-4, the slidable constraint cover 70 has a front end that comprises a constraint projection section 71. The slidable constraint cover 70 has two opposite sides each comprising a slide protrusion 72 formed thereon. The two slide protrusions 72 are respectively and slidably received in and thus located between the slide grooves 32 of the two side boards 30 for sliding movement in frontward and rearward directions along the slide grooves 32.

Referring to FIGS. 1-4, the chain tool 80 is attached to a rear end of the slidable constraint cover 70.

Figure 5:
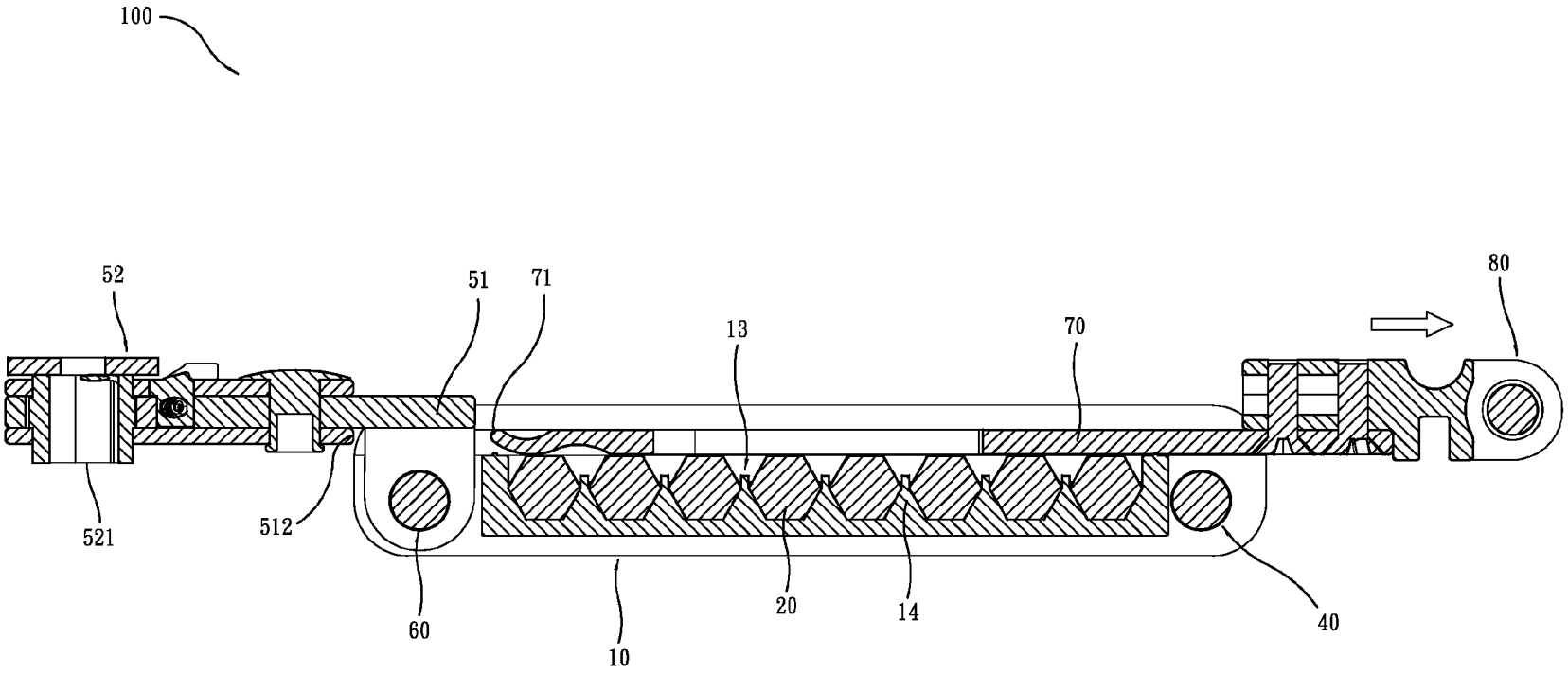
FIG. 5 is a schematic view illustrating an operation of the embodiment of FIG. 1.
Figure 6:
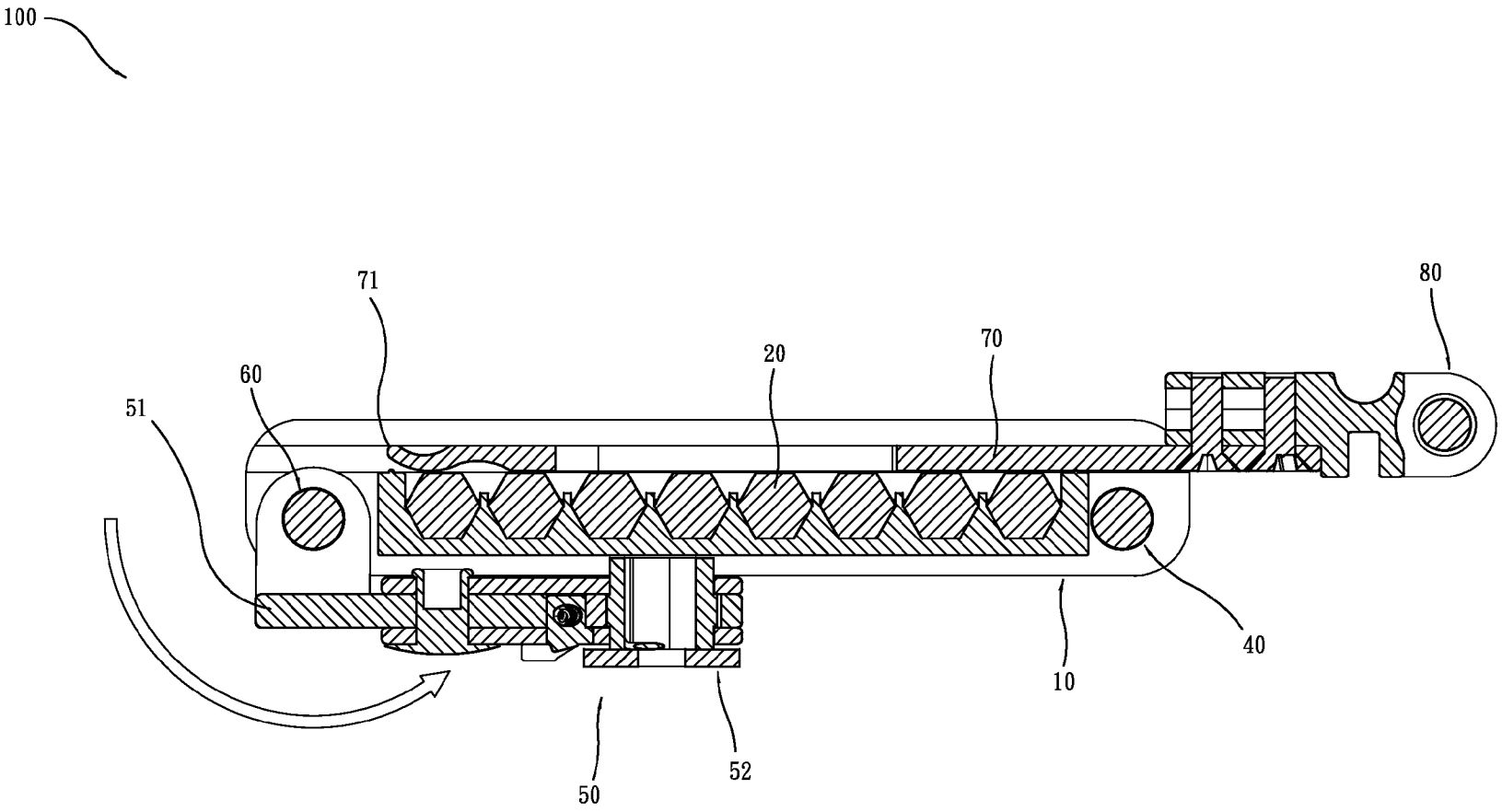
FIG. 6 is another schematic view illustrating the operation of the embodiment of FIG. 1.
Figure 7:
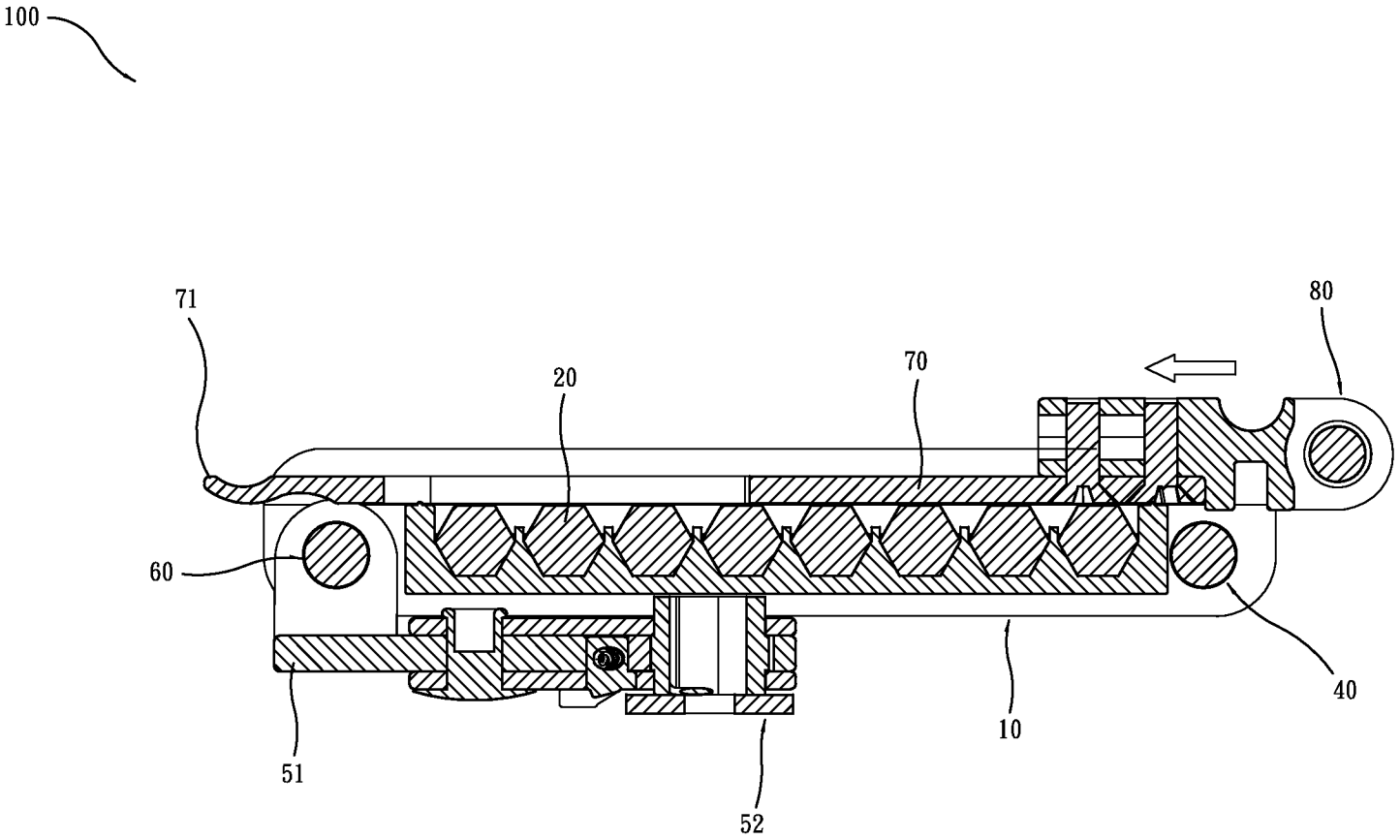
FIG. 7 is a further schematic view illustrating the operation of the embodiment of FIG. 1.

The above provides a description of the constituent components of a ratchet wrench tool set 100 according to a preferred embodiment of the present invention and assembling thereof. An operation and use of the present invention will be described as follows:

To store or carry out the present invention, the slidable constraint cover 70 is first moved, through sliding, in the rearward direction (as shown in FIG. 5) to release engagement between the constraint projection section 71 and the constraint step section 512 of the ratcheting device 50. Under this condition, a force may be applied to rotate the ratcheting device 50 downward to a storage position, where the ratcheting device 50 is set in contact engagement with a bottom of the box 10 (as shown in FIG. 6). Then, the slidable constraint cover 70 is moved, through sliding, frontwards (as shown in FIG. 7) to allow the slidable constraint cover 70 to close the receiving space 13 of the box 10 and thus preventing the tool bits 20 from falling out. In this way, the overall size can be greatly reduced to improve easiness of carrying and reduce the amount of space occupied for storage.

To use the ratcheting head 52 of the present invention to wrench or rotate an object, the slidable constraint cover 70 is first moved rearwards through sliding and then, the ratcheting device 50 is rotated upward to an operation position. Subsequently, the slidable constraint cover 70 is moved frontwards through sliding to have the constraint projection section 71 of the slidable constraint cover 70 engages with the constraint step section 512 of the ratcheting device 50 so as to retain the ratcheting device 50 in position to facilitate wrenching of the object.

Figure 8:
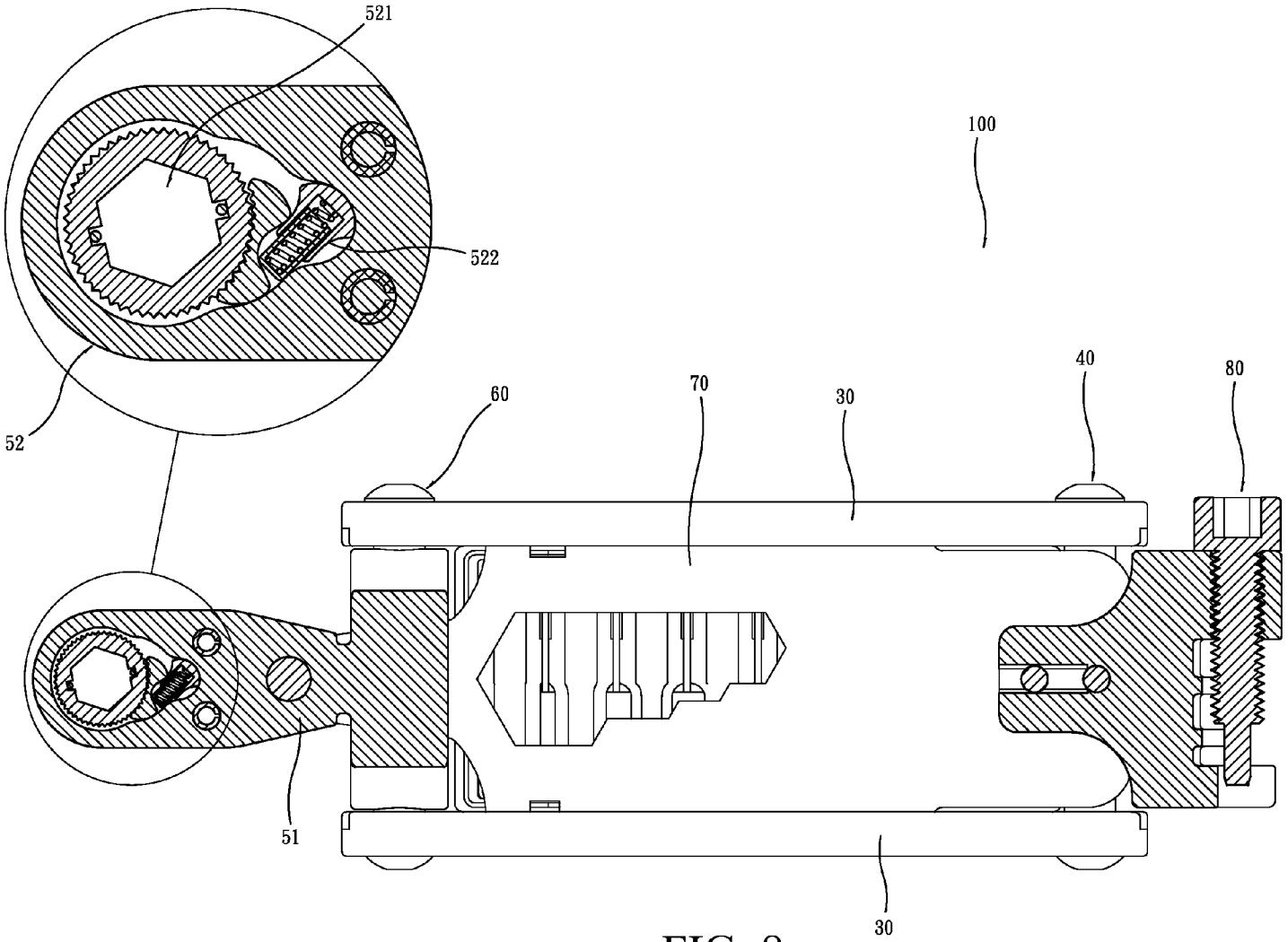
FIG. 8 is another cross-sectional view of the embodiment of FIG. 1, an enlarged view of a portion thereof being also illustrated.

Further, according to the present invention, the ratcheting head 52 may be a bi-directional ratcheting mechanism, wherein through switching of a switch lever 522 arranged on the ratcheting head 52 (as shown in FIG. 8), the wrenching direction of the ratcheting head 52 can be changed. Such a direction change mechanism is well known and further detail is not necessary. It is certain that the ratcheting head 52 may alternatively be a unidirectional ratcheting mechanism, which does not allow for change of direction; however, the effectiveness achievable with the present invention is not affected.

Further, although in the above-described embodiment, the first positioning sections of the box are raised blocks and the second positioning sections of the side boards are recesses, it is also feasible to make the first positioning sections of the box recesses and the second positioning sections of the side boards raised block, where the same effect of coupling and positioning can also be achieved.

Figure 9:
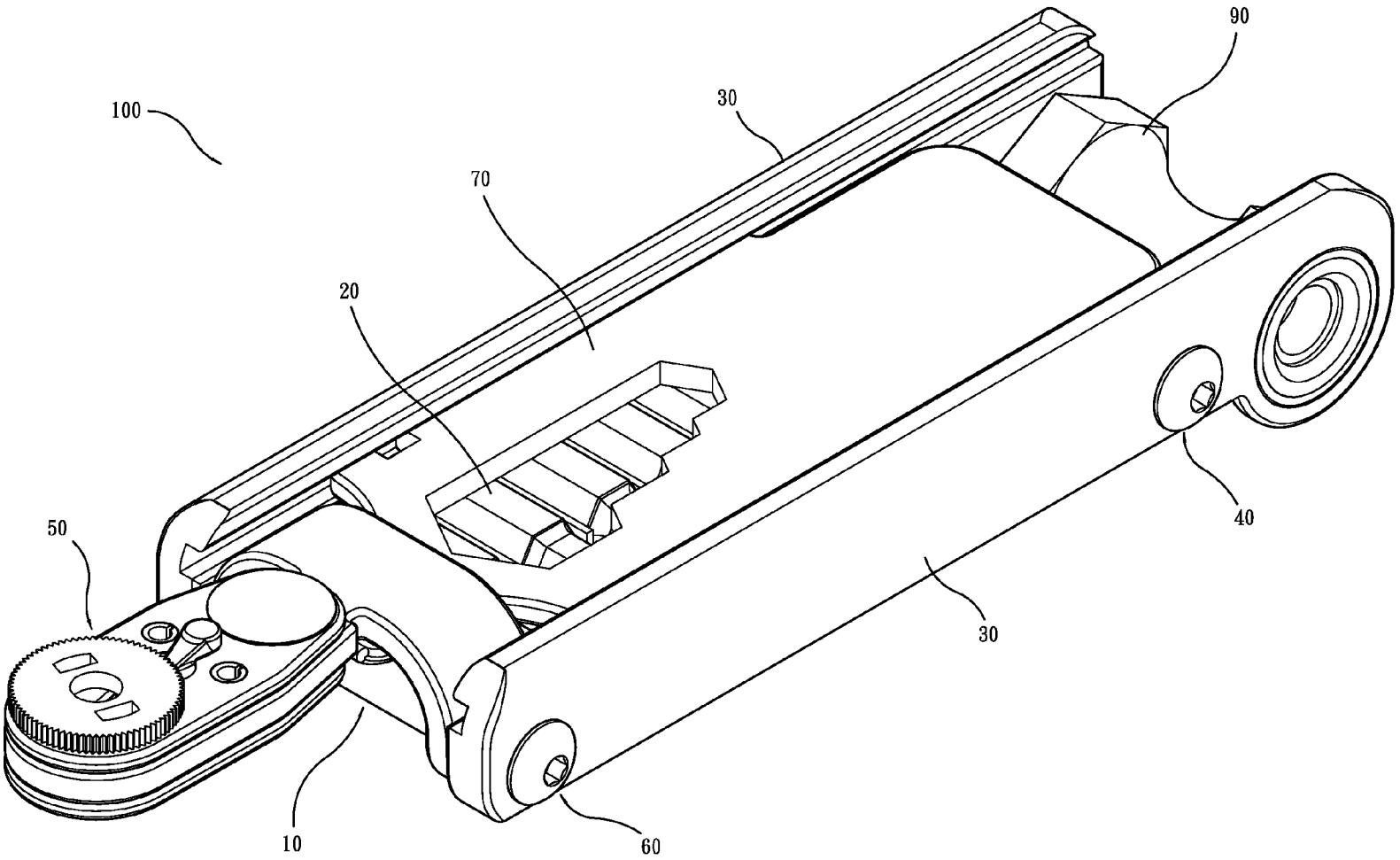
FIG. 9 is a perspective view illustrating another embodiment of the present invention.

In an embodiment of the present invention, as shown in FIG. 9, a seat 90 that is provided for mounting an inflation canister may be arranged, in a removable manner, between the rear ends of the two side boards 30. With such an arrangement, the present invention may additionally be used to inflate a flat tire.

The present invention provides an arrangement that combines a ratcheting device, a toolbox, tool bits, a chain tool, and a seat for inflation canister together, providing easiness of carrying and also providing complete functions of repairing and maintenance. The present invention also allows the ratcheting device to be rotated for folding to a storage position in order to reduce the overall length to enhance carrying thereof.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A ratchet wrench tool set, comprising:

a box, which comprises a receiving space defined therein;

a plurality of tool bits, which is removably positioned in the receiving space of the box;

two side boards, which are respectively mounted to two opposite sides of the box, each of the side boards having an inside surface in which a slide groove is formed;

a ratcheting device, which comprises a rotary connection plate and a ratcheting head mounted to the rotary connection plate, the rotary connection plate being rotatably mounted to front ends of the two side boards and being reciprocally rotatable between an operation position and a storage position, the rotary connection plate comprising a constraint step section formed thereon; and a slidable constraint cover, which has a front end that comprises a constraint projection section and two sides each comprising a slide protrusion formed thereon, the slide protrusions being respectively and slidably receive in the slide grooves of the two side boards to allow the slidable constraint cover to move frontwards and rearwards through sliding along the slide grooves;

wherein when the slidable constraint cover is moved frontwards through sliding, the constraint projection section engages the constraint step section of the ratcheting device to set and retain the ratcheting device in the operation position and when the slidable constraint cover is moved rearwards through sliding, the constraint projection section is separated from the constraint step section to allow the ratcheting device to rotate to the storage position.

2. The ratchet wrench tool set as claimed in claim 1, wherein the box comprises a bottom wall and a circumferential wall integrally formed with and extending upward from a circumference of the bottom wall, the bottom wall and the circumferential wall surrounding and collectively delimiting the receiving space, a plurality of clamp blocks being formed on the bottom wall and received in the receiving space in a predetermined arrangement to allow the clamp blocks to engage and hold the tool bits.

3. The ratchet wrench tool set as claimed in claim 1, wherein the box has two opposite outside surfaces on each of which a plurality of first positioning sections is formed, the two side boards each having an inside surface in which a plurality of second positioning sections is formed, the first positioning sections and the second positioning sections being engageable with each other for positioning and coupling.

4. The ratchet wrench tool set as claimed in claim 3, wherein the first positioning sections each comprise a raised block and the second positioning sections each comprise a recess.

5. The ratchet wrench tool set as claimed in claim 3, wherein the first positioning sections each comprise a recess and the second positioning sections each comprise a raised block.

6. The ratchet wrench tool set as claimed in claim 1 further comprising a fastening member, each of the side boards comprising a fastening through-hole formed therein at a location adjacent to a rear end thereof, the fastening member comprising an elongate nut and a bolt and received through and positioned in and between the fastening through-holes of the two side boards to fix the two side boards to the two outside surfaces of the box.

7. The ratchet wrench tool set as claimed in claim 1 further comprising a rotary joint member, each of the side boards comprising a rotary joint through-hole formed therein at a location adjacent to a front end thereof, the rotary connection plate having two side portions each comprising a rotatable connection hole corresponding in position to each, the rotary connection plate comprising an elongated nut and a bolt rotatably received through the rotary joint through-holes of the two side boards and the rotatable connection hole of the rotatory connection plate to rotatably couple the rotary connection plate between the front ends of the two side boards.

8. The ratchet wrench tool set as claimed in claim 1 further comprising a chain tool, which is attached to a rear end of the slidable constraint cover.

9. The ratchet wrench tool set as claimed in claim 1, wherein the ratcheting head comprises a bi-directional ratcheting mechanism.

10. The ratchet wrench tool set as claimed in claim 1 further comprising a seat adapted to receive an inflation canister to install thereon and mounted, in a removable manner, between rear ends of the two side boards.

* * * * *